US005117090A

United States Patent [19]

Askins

[11] Patent Number: 5,117,090

[45] Date of Patent: May 26, 1992

[54] ELECTRIC HAIR CURLING APPARATUS INCLUDING A REMOVABLE BATTERY PACK AND A FIBER OPTIC CABLE ILLUMINATION ARRANGEMENT

[76] Inventor: Vicki R. Askins, 8105 Royal Dr., Chattanooga, Tenn. 37421

[21] Appl. No.: 559,675

[22] Filed: Jul. 23, 1990

[51] Int. Cl.[5] ..... H05B 1/02; A45D 4/12

[52] U.S. Cl. ..... 219/222; 132/229; 132/233; 219/242; 219/492; 219/506

[58] Field of Search ..... 219/222-226, 219/242, 506, 492, 493; 132/229, 233

[56] References Cited

U.S. PATENT DOCUMENTS

| | | | |
|---|---|---|---|
| 3,410,985 | 11/1968 | Giacchero | 132/229 |
| 4,624,271 | 11/1986 | Kim | 219/222 X |
| 4,984,591 | 1/1991 | Jacobi | 132/229 |

OTHER PUBLICATIONS

"Vidal Sassoon SmartSetter 25", p. 90, item #1, W. Bell Co. 1989-1990 Merchandise Catalog.

*Primary Examiner*—Anthony Bartis

*Attorney, Agent, or Firm*—Leon Gilden

[57] ABSTRACT

An electric hair curling apparatus includes a housing having a transparent lid covering a base member mounting a plurality of variously sized heating posts, each arranged to mount and heat a respectively sized curler. A manually settable digital timing mechanism is provided to permit the curlers to be automatically heated at a predetermined time and for a predetermined period selected by the user. A main fiber optic cable associated with and extending from an on-off indicator light associated with the timer enhances visibility of the front panel of the housing during limited light conditions and communicates with other fiber optic cables providing visible framing of the side walls and top panel of the lid. A battery pack in the housing energizes the heating posts.

2 Claims, 3 Drawing Sheets

ELECTRIC HAIR CURLING APPARATUS INCLUDING A REMOVABLE BATTERY PACK AND A FIBER OPTIC CABLE ILLUMINATION ARRANGEMENT

BACKGROUND OF THE INVENTION

1. Field of the Invention

The field of invention relates to hair curling devices, and more particularly pertains to a new and improved electric hair curling apparatus wherein the same is arranged for inclusion of a timing mechanism.

2. Description of the Prior Art

The prior art hair curling apparatus have included various assisting features in their use such as an indicator light for indication of heating of the various curling posts within the organization and the like. Such apparatus, however, has failed to include a timing mechanism to allow an individual to pre-set the curlers to come on and start heating up at a designated time and automatically shut off one hour later or at a time pre-set by the user. For example, the prior art includes U.S. Pat. No. 4,624,271 to Kin wherein a plural series of curling rollers are mounted on respective posts. The organization, however, fails to provide assisting structure beyond the use of heated curling rollers to assist in a grooming event.

U.S. Pat. No. 3,610,878 to Thomas sets forth an electrically heated hair setting organization wherein the plastic hair curlers are heated over an associated post wherein the organization utilizes an on/off switch and indicator light in association with the post, as well as an indicator of heating of the posts related to a thermostat mounted within the organization.

U.S. Pat. No. 4,673,798 to Contri, et al. sets forth a curling iron utilizing a circuit having a safety shut-off in the timing circuit to be set after each time it receives a signal to engage the curling iron in association with a thermostat.

U.S. Pat. No. 4,365,140 to Bast, et al. sets forth a dual temperature hair curling iron utilizing dual thermostats in association with a switching mechanism to maintain a predetermined temperature gradient of the curling iron.

U.S. Pat. No. 2,197,876 to Racen sets forth a hair curling organization wherein various switches control a circuit maintaining a predetermined temperature set into the device.

As such, it may be appreciated that there continues to be a need for a new and improved electric hair curling apparatus as set forth by the instant invention which addresses both the problems of ease of use, as well as effectiveness in presenting a complete organization to assist in a hair curling event and in this respect, the present invention substantially fulfills this need.

SUMMARY OF THE INVENTION

In view of the foregoing disadvantages inherent in the known types of hair curling apparatus now present in the prior art, the present invention provides a electric hair curling apparatus wherein the same provides for organization permitting pre-timing of a heating event in the use of the associated hair curlers. As such, the general purpose of the present invention, which will be described subsequently in greater detail, is to provide a new and improved electric hair curling apparatus which has all the advantages of the prior art hair curling apparatus and none of the disadvantages.

To attain this, the present invention includes an apparatus including a base mounting a series of variable sized posts thereon, each of the posts arranged for mounting a respective curler thereon of a respective size in relationship to the series of posts. The apparatus includes a timing mechanism permitting timing of a hair curler heating event of the hair curlers arranged on the various posts. The housing further includes a fiber optic cable in cooperation with an indicator light, wherein the fiber optic cable is directed along a forward wall of the housing in cooperation with the indicator light for providing visual indication of orientation of the forward wall during conditions of limited available light. Further, the housing and an associated base member includes a cavity to receive a battery pack within the housing to effect and permit usage of the apparatus utilizing the battery pack as a convenient power supply for this purpose.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electric hair curling apparatus which has all the advantages of the prior art hair curling apparatus and none of the disadvantages.

It is another object of the present invention to provide a new and improved electric hair curling apparatus which may be easily and efficiently manufactured and marketed.

It is a further object of the present invention to provide a new and improved electric hair curling apparatus which is of a durable and reliable construction.

An even further object of the present invention is to provide a new and improved electric hair curling apparatus which is susceptible of a low cost of manufacture with regard to both materials and labor, and which accordingly is then susceptible of low prices of sale to the consuming public, thereby making such electric hair curling apparatus economically available to the buying public.

Still yet another object of the present invention is to provide a new and improved electric hair curling apparatus which provides in the apparatuses and methods of the prior art some of the advantages thereof, while simultaneously overcoming some of the disadvantages normally associated therewith.

Still another object of the present invention is to provide a new and improved electric hair curling apparatus wherein the same includes cooperative structure in association with hair curling and heating to assist in a grooming event including a timing mechanism to present a timing of the heating of the hair curlers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
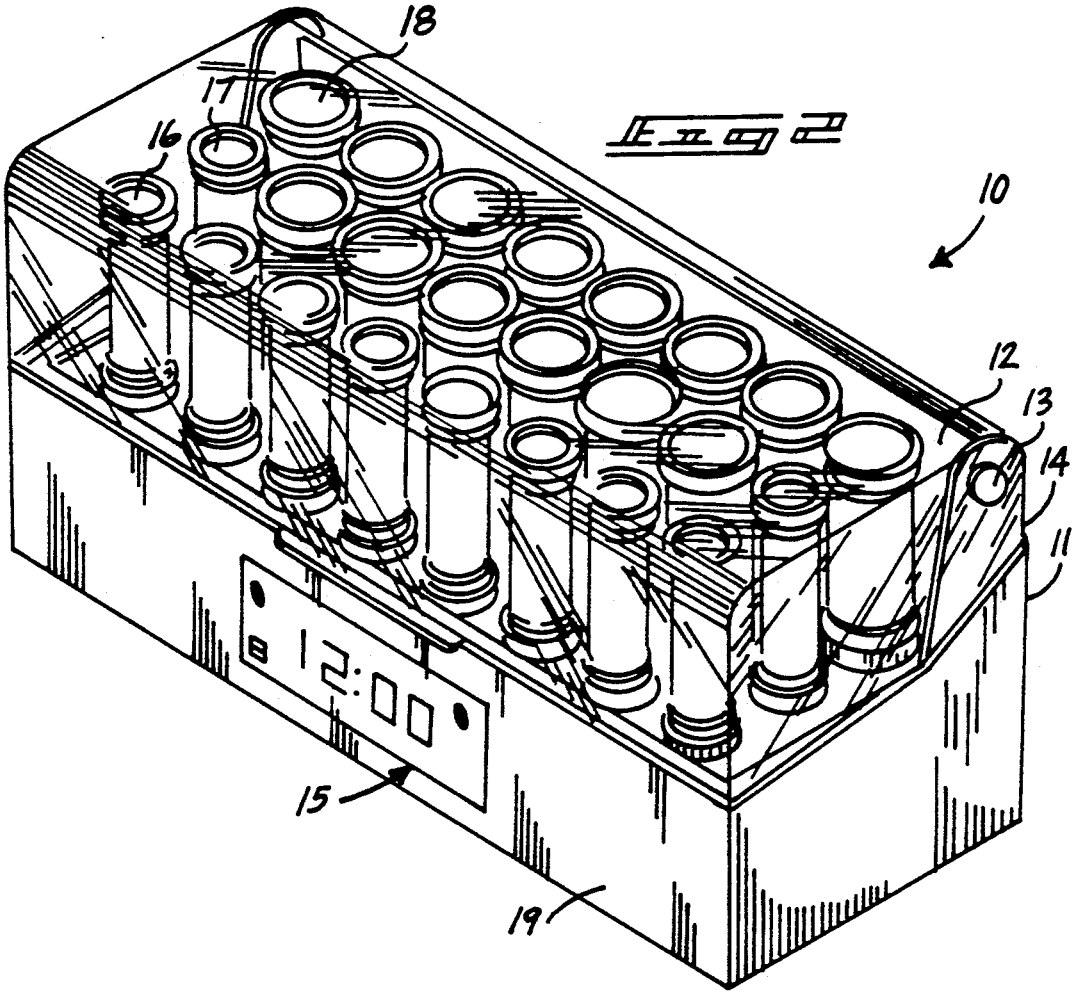
PRIOR ART Fig 2
FIG. 2 is an isometric illustration of the instant invention.
Figure 3:
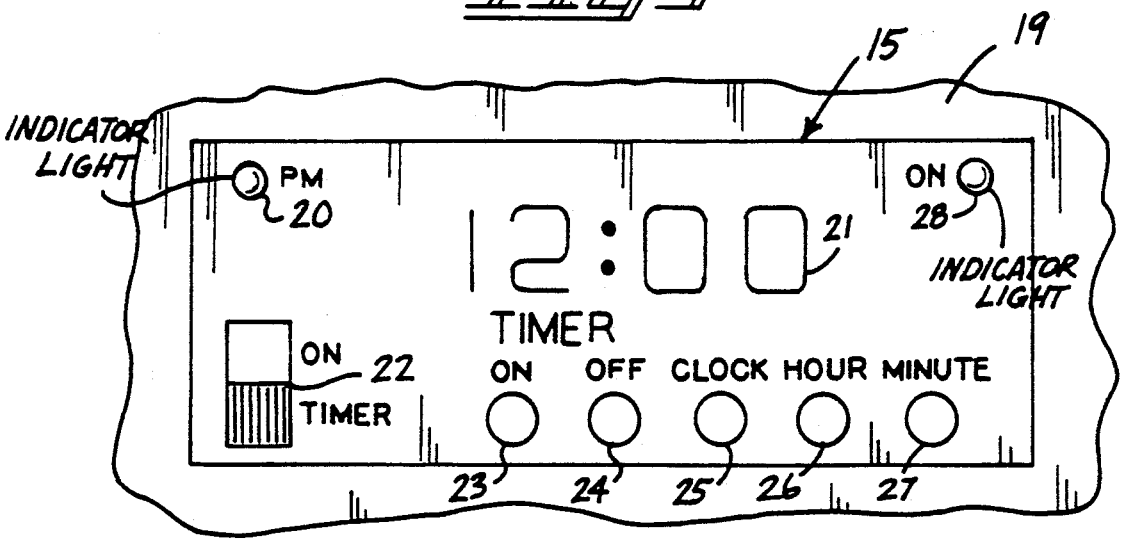
FIG. 3 is an orthographic front view, taken in elevation, illustrating details of the control panel utilized by the instant invention.
Figure 4:
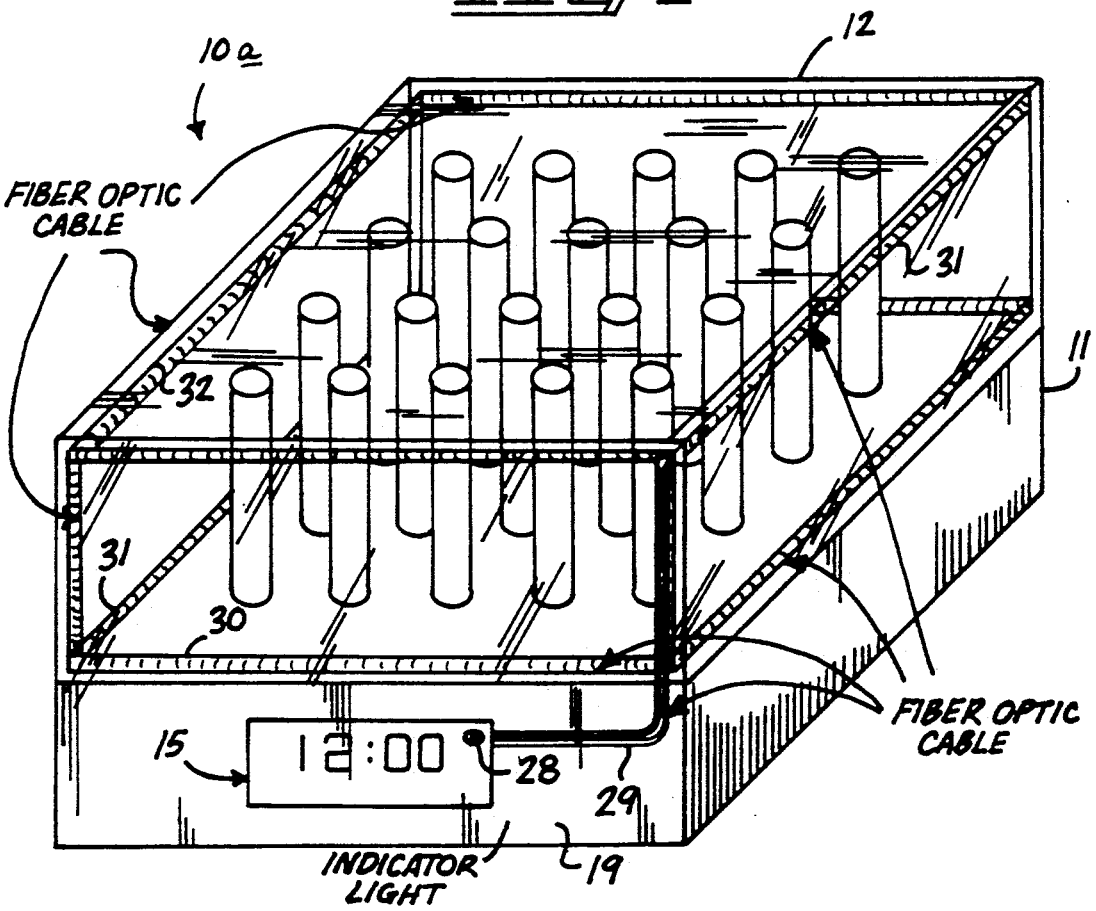
FIG. 4 is an isometric illustration of a modified hair curling apparatus utilized by the instant invention.

With reference now to the drawings, and in particular to FIGS. 2 to 4 thereof, a new and improved electric hair curling apparatus embodying the principles and concepts of the present invention and generally designated by the reference numeral 10*a* and 10*b* will be described.

Figure 1:
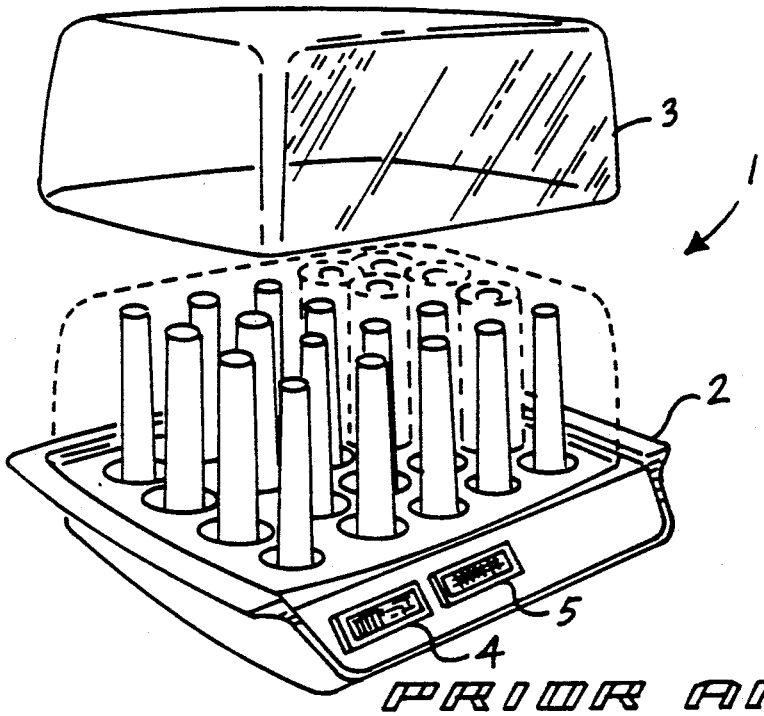
FIG. 1 is an isometric illustration of a prior art hair curling apparatus.

FIG. 1 illustrates a prior art hair curling apparatus 1 wherein a base 2 includes a transparent closure lid superiorly mounted relative to the base, with an on/off switch 4 including an associated indicator light with a further indicator light 5 to indicate a heating event in association with a thermostat of the apparatus of FIG. 1.

More specifically, the electric hair curling apparatus 10 of the instant invention essentially comprises a base 11, with a transparent lid 12 pivotally mounted thereto about spaced pivot axles 13 directed through support legs 14. The support legs are directed upwardly and rearwardly of each side of the base 11. A control panel 15 is mounted to a forward wall of the base 11 with a first, second, and third series of increasingly larger heating rods 16, 17, and 18 for receiving companion curling rollers slidably thereon, wherein the heating rods are electrically heated by conventional resistance heaters to effect heating of the curling rollers mounted thereon. Heating to a predetermined temperature is conventionally effected through a thermostat arrangement to control and maintain the predetermined temperature selected is well known in the art as exemplified in U.S. Pat. No. 3,610,878 incorporated herein by reference.

The control panel 15, as illustrated in FIG. 3 for example, includes a p.m. indicator light 20 in association with the L.E.D. (light emitting diode) clock that is set through the use of a clock engaging switch 25 that is pressed simultaneously with the pressing of the hour set switch 26 and the minute set switch 27.

To engage the associated timer, a timer engaging switch 22 is switched to an on position, whereupon a timer-on switch 23 is pressed in while simultaneously actuating the hour and minute button switches 26 and 27 respectively to indicate in the L.E.D. clock readout 21 of the time of energizing of the heating elements of the device, while the timer-off switch 24 is subsequently engaged, while simultaneously pressing the hour and minute switch 26 and 27 to ascertain the time that the heating elements will be switched off. This effects the timing event in use of the device. The on/off indicator light 28 is illuminated when a heating event is taking place, in much the same manner as set forth in U.S. Pat. No. 3,610,878 utilizing the indicator light 28 in the same circuit as a heating circuit of the heating of resistance elements with the various heating rods 16, 17, and 18.

A modified electric hair curling apparatus 10*a*, as illustrated in FIG. 4, wherein the on/off indicator light 28 is cooperative with a main fiber optic cable 29 directed through the forward face 19 of the base 11. The main fiber optic cable 29 is in turn in illuminating association with a front panel fiber optic framing cable 30, side panel rectangular fiber optic cable framing members 31, and a top panel rectangular fiber optic cable framing member 32 to effect illumination of the lid and its geometric parameter for use by individuals, particularly in dim light conditions to provide illumination of the positioning and orientation of the various components of the device.

Figure 5:
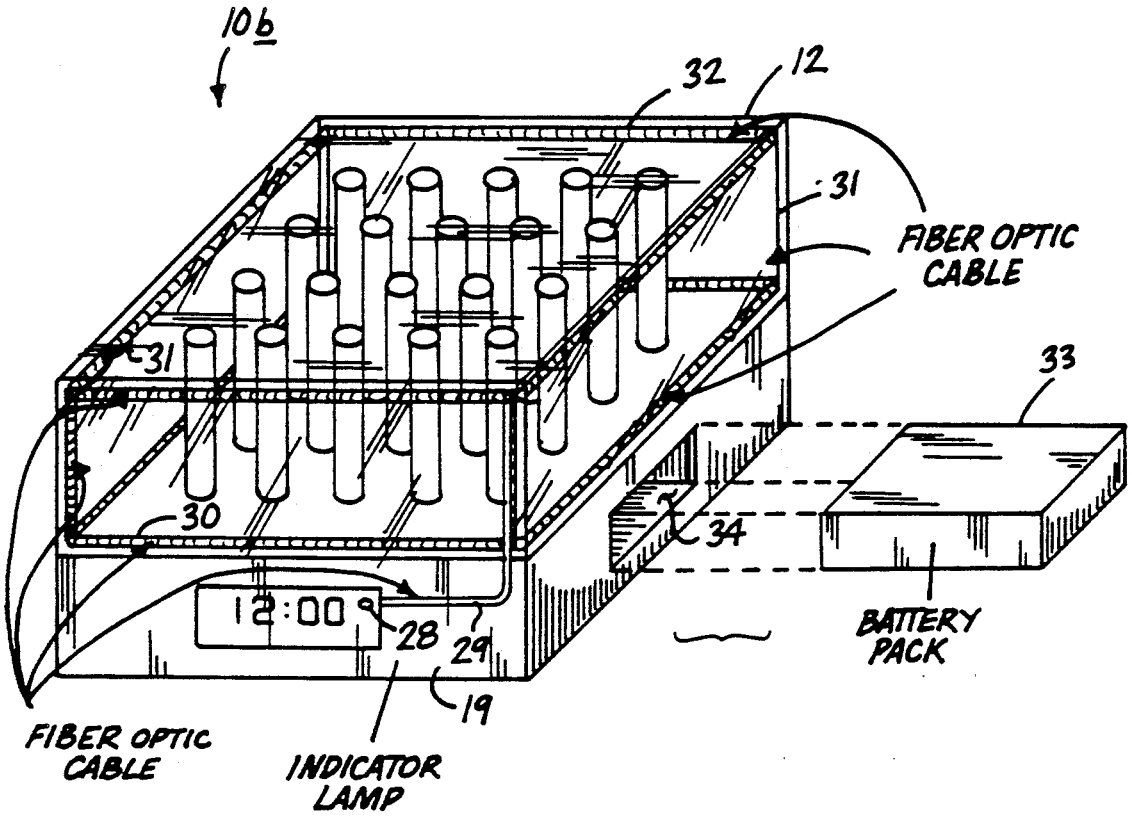
FIG. 5 is an isometric illustration of the invention including a removable battery pack.

FIG. 5 illustrates a further modified electric hair curling apparatus 10*b* utilizing a removable battery pack 33 receivable within a side wall receiving cavity 34 of the base 11 to provide portable usage of the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electric hair curling apparatus, comprising, in combination, a base member, including spaced side walls, a top wall, and a forward wall, the top wall including plural series of heating rods with curling roller slidably mounted thereon, the heating rods defining a first, second, and third series of aligned heating rods, wherein the first, second, and third series of heating rods are of an increasing predetermined diameter, transparent lid pivotally mounted to the base about spaced pivot axles, wherein the pivot axles are oriented rearwardly and upwardly of the top wall of the base, a control panel mounted on the forward wall, the control panel including a light emitting diode clock, a timer means for selectively heating the heating rods transferring heat from the heating rods to the curling rollers associated with each of the heating rods, said timer means including a timer engaging switch for selective engagement of the timer means, clock setting means for cooperation with a timer engaging switch for selective actuation and disengaging of the timer means and associated heating of the heating rods, an on/off indicator light in cooperation with the timer means to provide visual indication of actuation of the timer means and associated heating of the heating rods, a main fiber optic cable in light transmitting relationship with the on/off indicator light, wherein the main fiber optic cable is exposed and is directed along the forward wall for providing visual indication of the forward wall during limited light conditions, and wherein the main fiber optic cable is in communication with a front panel fiber optic cable, side panel fiber optic cables and a top panel fiber optic cable, wherein the front panel fiber optic cable defines a visible rectangular frame of a forward wall of the transparent lid, the side panel fiber optic cables provide visible rectangular framing of side walls of the transparent lid, and the top panel fiber optic cable provides a visible rectangular framing of a top wall of the transparent lid.

2. An apparatus as set forth in claim 1 wherein a side wall of the base member includes a cavity and a battery pack complementarily received within the cavity.

* * * * *